US006012744A

United States Patent [19]

Wilson et al.

[11] Patent Number: 6,012,744

[45] Date of Patent: Jan. 11, 2000

[54] HEAVY WEIGHT DRILL PIPE

[75] Inventors: Gerald E. Wilson, Montgomery; R. Thomas Moore, Bryan; Wei Tang, College Station, all of Tex.

[73] Assignee: Grant Prideco, Inc., The Woodlands, Tex.

[21] Appl. No.: 09/071,253

[22] Filed: May 1, 1998

[51] Int. Cl.[7] ..... F16L 13/02

[52] U.S. Cl. ..... 285/288.1; 285/333; 285/422; 403/343; 29/469

[58] Field of Search ..... 285/333, 334, 285/355, 390, 288.1, 422; 403/343; 29/469

[56] References Cited

U.S. PATENT DOCUMENTS

| | | | |
|---|---|---|---|
| 3,773,359 | 11/1973 | Chance et al. | 285/286 |
| 3,784,238 | 1/1974 | Chance et al. | 285/288.1 |
| 4,416,476 | 11/1983 | Garrett | 285/288.1 |
| 4,460,202 | 7/1984 | Chance | 285/288.1 |
| 4,811,800 | 3/1989 | Hill et al. | 175/323 |

OTHER PUBLICATIONS

Grant Prideco brochure on Heavyweight Drill Pipe.

*Primary Examiner*—Dave W. Arola
*Attorney, Agent, or Firm*—Browning Bushman

[57] ABSTRACT

A heavy weight drill pipe member is disclosed for use in drilling high angle and horizontal well bores in a corrosive environment. The heavy weight drill pipe member consists of a tubular member with a longitudinal bore therethrough, and includes connectors or tool joints attached at each distal end for connecting additional heavy weight drill pipe members. The tubular member and tool joints are preheated, water quenched and tempered to obtain a unique combination of hardness, a yield strength and impact strength for improved resistance to stress corrosion cracking and hydrogen embrittlement in a hydrogen sulfide environment. The tubular member includes a plurality of wear pads or protectors equidistantly spaced along the longitudinal axis of the tubular member to reduce bending stress in the pipe by limiting the degree of bend when the pipe is placed in compression in a high angle well bore. To reduce the chances of differential pressure sticking of the pipe when the pipe is used in high angle or horizontal well bores, each wear pad or protector is provided with spiral grooves therein. Each wear pad or protector may also be hard faced or hard banded to reduce wear.

23 Claims, 2 Drawing Sheets

HEAVY WEIGHT DRILL PIPE

FIELD OF THE INVENTION

The present invention primarily relates to specially treated heavy weight drill pipe used for drilling high angle or horizontal well bores in a corrosive environment. In particular, this invention relates to heat treated drill pipe having a weight per foot that is intermediate the weight per foot of the drill collars and the drill pipe, one or both of which combine with the intermediate weight pipe to make up the drill stem.

BACKGROUND OF THE INVENTION

Drill collars are very stiff with a wall thickness of approximately 2" in order that most of the bending takes place in the connections. Consequently, fatigue cracks develop in the drill collar connections. Drill pipe has a thin wall tube and a wall thickness of approximately ⅜" so that most all of the flexing takes place in the tube and not in the connections. Thus, fatigue cracks develop in the tube near the fade out of the upset or protectors. Intermediate weight drill string members are usually referred to as "heavy weight" drill pipe to distinguish between the regular drill pipe and drill collars, and have an approximate 1" wall thickness resulting in a stiffness somewhere between that of drill collars and drill pipe creating characteristics common to both drill pipe and drill collars in that some of the bending takes place in the connections resulting in some fatigue cracks, but not to the degree found in drill collar connections.

In the past, standard heavy weight (thick wall) drill pipe has worked well in vertical or near vertical well bores in non-corrosive environments, but has been less than successful in horizontal wells drilled in high angle and corrosive environments.

Heavy weight drill pipe is used as transition pipe between the heavy drill collars and the relatively light weight drill pipe to prevent shock loads and bending stress from reaching the drill pipe. When heavyweight drill pipe is not used, the drill pipe near the top of the drill collars can suffer severe fatigue damage and failure.

In horizontal drilling, heavy weight drill pipe is run in compression to put weight on the drill bit. When the hole was kicked off more or less gradually, the heavy weight drill pipe was subjected to relatively small bending stresses. Now, however, with the hole being kicked off at 15 to 25 degrees per 100 feet instead of 3 degrees per 100 feet, substantial bending stress is imposed on the heavy weight drill pipe. The pipe, when in compression is also being forced against the side of the hole and subjected to differential pressure sticking.

Additionally, stress corrosion cracking failures in heavy weight drill pipe are increasing due to more corrosive drilling fluids, including the increased use of low-ph, low-solids brine and polymer muds, and the increased presence of hydrogen sulfide and carbon dioxide.

Standard heavy weight drill pipe tubes are made from normalized AISI 1340 carbon steel that has a mixed micro structure with large grains, resulting in a 55,000 psi minimum tensile yield strength and a low impact strength of approximately 15 ft.-lbs. This is a soft material that is not very resistant to fatigue because of the large grain size and low impact strength. Consequently, this micro structure is less resistant to stress corrosion cracking and hydrogen embrittlement.

Standard heavy weight drill pipe tool joints are made from drill collar material which is standard AISI 4145 modified but is then liquid quenched and heat tempered to a high Brinell hardness between 302 and 341. The minimum tensile yield strength on standard heavy weight drill pipe tool joints will run approximately 110,000 psi and its impact strength is approximately 50 ft.-lbs. Although the high hardness of heavy weight drill pipe tool joints is not preferred for hydrogen sulfide service, the tool joints are not as critical as the tubing because the stresses are low in the tool joints when compared to the tubes. However, increased bending stresses in the tube are directly related to the stiffness encountered in standard heavy weight drill pipe tool joints.

Although conventional heavy weight drill pipe addresses reducing fatigue, stress and wear on drill string members used in conventional or deviated well bores by incorporating certain structural features, these features are inadequate for use in high angle and horizontal holes in a corrosive environment. For example, prior art such as U.S. Pat. Nos. 3,773,359 to Chance et al. and 4,811,800 to Hill et al. utilize standard heavy weight drill pipe with upsets or protectors, spiraling in the surface of the upsets and/or hard banding the exterior surface of the protectors which collectively are inadequate for use in a high angle or horizontal well bores that have a corrosive environment. Therefore, there is a specific need for a heavy weight drill pipe that can reduce fatigue in high angle and high angle and/or horizontal well bores that have a corrosive environment.

SUMMARY OF THE INVENTION

Therefore, it is a primary object of the present invention to provide a heavy weight drill pipe member for use in a high angle or horizontal well bore that has a corrosive environment.

It is an object of the present invention to provide a heavy weight drill pipe member that is specially treated to attain a unique combination of material properties including a preferred Brinell hardness, yield strength and impact strength for improved resistance to stress corrosion cracking hydrogen embrittlement, bending stresses and shock loads encountered in deviated well bores having a corrosive environment.

It is another object of the present invention to provide a heavy weight drill pipe member with a tubular body wherein at least substantially the entire tubular body has a Brinell hardness of about 217 to about 241 for improved resistance to stress corrosion cracking and hydrogen embrittlement, a yield strength of about 90,000 psi to about 105,000 psi for improved resistance to bending stresses, and an impact strength of at least about 100 foot pounds for improved resistance to shock loads.

It is yet another object of the present invention to provide a heavy weight drill pipe member with a first and a second tool joint at a first and a second distal end of the tubular body wherein at least substantially the entirety of each first and second tool joint has a Brinell hardness of about 248 to about 269 for improved resistance to stress corrosion cracking and hydrogen embrittlement, a yield strength of about 100,000 psi to about 115,000 psi for improved resistance to bending stresses and an impact strength of at least about 65 foot pounds for improved resistance to shock loads.

It is still another object of the present invention to provide a method for producing a heavy weight drill pipe member by preheating an elongated tubular member to about 1625° F.–1675° F., then liquid quenching the preheated tubular member for about 10 to 20 minutes, and finally tempering the quenched tubular member for about 20 to 40 minutes at about 1360° F.–1410° F. to achieve a Brinell hardness of about 217 to about 241, a yield strength of about 90,000 psi to about 105,000 psi and an impact strength of at least about 100 foot pounds throughout substantially the entire tubular member.

It is still another object of the present invention to provide a method for producing a heavy weight drill pipe member having a first and second tool joint connected to a respective first and second distal end of the tubular member by preheating the first and second tool joint to about 1695° F.–1745° F., then liquid quenching the first and second tool joint for about 10 to 20 minutes, and finally tempering the quenched first and second tool joint for about 30 to 45 minutes at about 1270° F.–1330° F. to achieve a Brinell hardness of about 248 to about 269, a yield strength of about 100,000 psi to about 115,000 psi and an impact strength of at least 65 foot pounds throughout substantially the entirety of each first and second tool joint which may then be attached to a respective first and second distal end of the tubular member.

It is an advantage of the present invention to provide the heavy weight drill pipe member with a first and second tool joint attached to a respective first and second distal end of the tubular member wherein the first tool joint comprises a pin member having external threads and the second tool joint comprises a box member having internal threads for threadably connecting a respective heavy weight drill pipe member.

It is another advantage of the present invention to provide the heavy weight drill pipe member with a first and second tool joint attached to a respective first and second distal end of the tubular member wherein at least one of the first and second tool joints comprises an internally threaded box having an axially extending internal diameter bore that is constant substantially along a longitudinal axis from the internal threads to adjacent at least one of the first and second distal ends of the tubular member for reducing fatigue and stiffness.

It is a feature of the present invention to provide the heavy weight drill pipe member with one or more spaced protectors along the longitudinal axis of the drill pipe to engage the wall of the well bore and limit the bending stress in the drill pipe by limiting the amount the drill pipe can bend when in compression.

It is another feature of the present invention to provide the heavy weight drill pipe member with one or more spaced protectors along the longitudinal axis of the drill pipe wherein each spaced protector includes a spiral groove on its outer circumferential surface to reduce differential pressure and sticking of the heavy weight drill pipe member in the well bore.

It is still another feature of the present invention to provide the heavy weight drill pipe member with one or more spaced protectors along the longitudinal axis of the drill pipe and a first and second tool joint at a respective first and second distal end of the drill pipe wherein one or more of the spaced protectors and the first and second tool joints are hard faced or banded for reducing wear.

The present invention is therefore directed to a heavy weight drill pipe member for use in a deviated well bore having a corrosive environment. The heavy weight drill pipe member includes a tubular body having a longitudinal bore therethrough, a first distal end and a second distal end. The tubular body is specially treated such that at least substantially the entire tubular body has a Brinell hardness of about 217 to about 241 for improved resistance to stress corrosion cracking and hydrogen embrittlement, a yield strength of about 90,000 psi to about 105,000 psi for improved resistance to bending stresses, and an impact strength of at least about 100 foot pounds as measured by a Charpy-V impact test at ambient temperatures for improved resistance to shock loads. In another embodiment, at least substantially the entire tubular body has a Brinell hardness of about 223 to about 235, a yield strength of about 95,000 psi to about 100,000 psi and an impact strength of at least about 100 foot pounds. In a preferred embodiment, at least substantially the entire tubular body has a Brinell hardness of about 229, a yield strength of about 95,000 psi and an impact strength at least about 100 foot pounds.

A first tool joint and a second tool joint are connected to a respective first and second distal end of the tubular body wherein at least substantially the entirety of each first and second tool joint are specially treated to achieve a Brinell hardness of about 248 to about 269 for improved resistance to stress corrosion cracking and hydrogen embrittlement, a yield strength of about 100,000 psi to about 115,000 psi for improved resistance to bending stresses and an impact strength of at least about 65 foot pounds as measured by Charpy-V impact test at ambient temperatures for improved resistance to shock loads. Each of the first and second tool joints have an open distal end and a longitudinal bore therethrough in communication with the longitudinal bore of the tubular body. In another embodiment, at least substantially the entirety of each first and second tool joint has a Brinell hardness of about 254 to about 263, a yield strength at about 105,000 psi to about 110,000 psi and an impact strength of at least about 65 foot pounds. In a preferred embodiment, at least substantially the entirety of each first and second tool joint has a Brinell hardness of about 258, a yield strength of about 105,000 psi and an impact strength of at least about 65 foot pounds.

The first tool joint preferably includes an externally threaded pin adjacent the open distal end for threadably connecting another heavy weight drill pipe member. The second tool joint preferably includes an internally threaded box adjacent the open distal end for threadably connecting another heavy weight drill pipe member. Thus, multiple heavyweight drill pipe members may be interconnected to form a continuous heavy weight drill pipe string of a desired length having the foregoing described material properties. The internally threaded box includes an axially extending internal bore that is constant substantially along the longitudinal axis from the internal threads to adjacent the second distal end of the tubular body for reducing fatigue in the heavy weight drill pipe member.

One or more upsets or protectors may be positioned along the longitudinal axis of the tubular body wherein each of the protectors has an outside diameter greater than an outside diameter of the tubular body but no greater than an outside diameter of each first and second tool joint for limiting the bending stresses in the tubular body while the heavyweight drill pipe is being run in the deviated well bore. Each of the one or more upsets or protectors may also include a spiral groove in an outer circumferential surface for reducing differential pressure and sticking of the heavy weight drill pipe as it is run in the deviated well bore. In one embodiment, the first and second tool joint and at least one of the one or more upsets or protectors are hard banded substantially about an outer circumferential surface for reducing wear on the surface of the heavy weight drill pipe as the upsets and first and second tool joint contact the wall of the deviated well bore.

In another embodiment, the heavy weight drill pipe member includes an elongate tubular member having a longitudinal bore therethrough, a first tool joint and a second tool joint positioned at a respective first distal end and second distal end of the tubular member. At least substantially the entire tubular member has a Brinell hardness of about 258 for improved resistance to stress corrosion cracking and hydrogen embrittlement, a yield strength of about 90,000 psi to about 105,000 psi for improved resistance to bending stresses and an impact strength of at least about 100 foot pounds as measured by a Charpy-V impact test at ambient temperatures for improved resistance to shock loads.

The first tool joint includes an externally threaded pin adjacent a distal end for threadably connecting another heavy weight drill pipe member and the second tool joint includes an internally threaded box adjacent a distal end for threadably connecting another drill pipe member. Thus, multiple heavy weight drill pipe members may be interconnected to form a continuous heavy weight drill pipe string of a desired length having the foregoing described material properties. The internally threaded box includes an axially extending internal bore that is constant substantially along the longitudinal axis from the internal threads to adjacent the second distal end of the tubular member for reducing fatigue in the heavy weight drill pipe member.

One or more upsets or protectors may be positioned along the longitudinal axis of the tubular member wherein each of the upsets or protectors has an outside diameter greater than an outside diameter of the tubular member but no greater than an outside diameter of the first and second tool joint for limiting the bending stresses in the tubular member. Each of the upsets or protectors may also include a spiral groove in an outer circumferential surface for reducing differential pressure sticking of the heavy weight drill pipe as it is run in the deviated well bore. The first and second tool joint and at least one of the one or more upsets or protectors are preferably hard banded substantially about an outer circumferential surface for reducing wear on the heavy weight drill pipe as the upsets and first and second joint contact the wall of the deviated well bore.

In a preferred method of producing a heavy weight drill pipe member for use in a deviated well bore having a corrosive environment, an elongated tubular member having a longitudinal bore therethrough is first preheated to about 1625° F. to 1675° F. The preheated tubular member is then liquid quenched for about 10 to 20 minutes and then tempered at about 1360° F. to about 1410° F. for about 20 to 40 minutes to achieve a Brinell hardness of about 217 to about 241, a yield strength of about 90,000 psi to about 105,000 psi and an impact strength of at least about 100 foot pounds throughout substantially the entire tubular member.

A first tool joint and a second tool joint each having an open distal end and a longitudinal bore therethrough are preheated to about 1695° F. to 1745° F. Each first and second tool joint are then liquid quenched for about 10 to 20 minutes and then tempered at about 1270° F, to about 1330° F. for about 30 to 45 minutes to achieve a Brinell hardness of about 248 to about 269, a yield strength of about 100,000 psi to about 115,000 psi and an impact strength of at least 65 foot pounds throughout substantially the entirety of each first and second tool joint. The first and second tool joints are then attached to a respective first and second distal end of the tubular member such that the longitudinal bore of each first and second tool joint is aligned and in communication with the longitudinal bore of the tubular member.

An outside diameter of the first tool joint adjacent an open distal end is then machined to form an externally threaded pin for connecting another heavy weight drill pipe member. The inside diameter of the second tool joint adjacent an open distal end is then machined to form an internally threaded box for connecting another heavy weight drill pipe member. The heavy weight drill pipe member may thus be interconnected with multiple other specially treated heavy weight drill pipe members to form a continuous heavy weight drill pipe string of a desired length for use in a deviated well bore having a corrosive environment.

These and other objects, advantages and features of this invention will be apparent to those skilled in the art from a consideration of the detailed description of the various embodiments wherein reference is made to the attached drawings and appended claims.

DETAILED DESCRIPTION OF PREFERRED EMBODIMENTS

Figure 1:
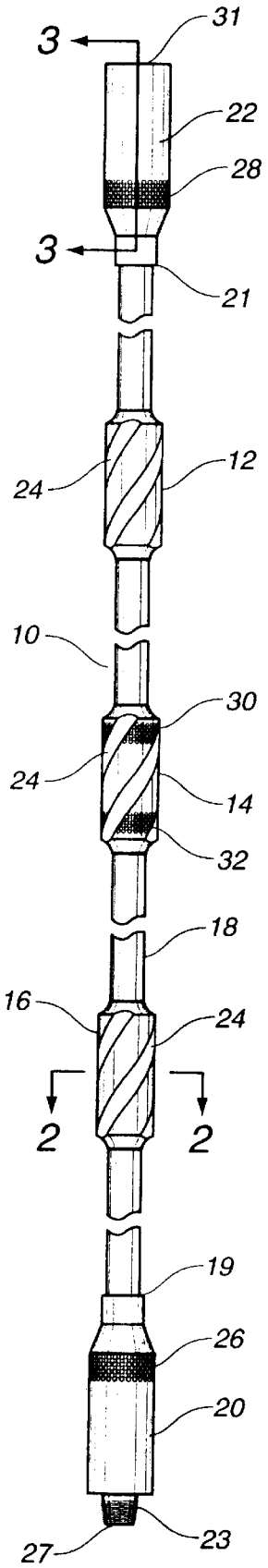
FIG. 1 is an elevation view of the heavy weight drill pipe of the present invention.
Figure 2:
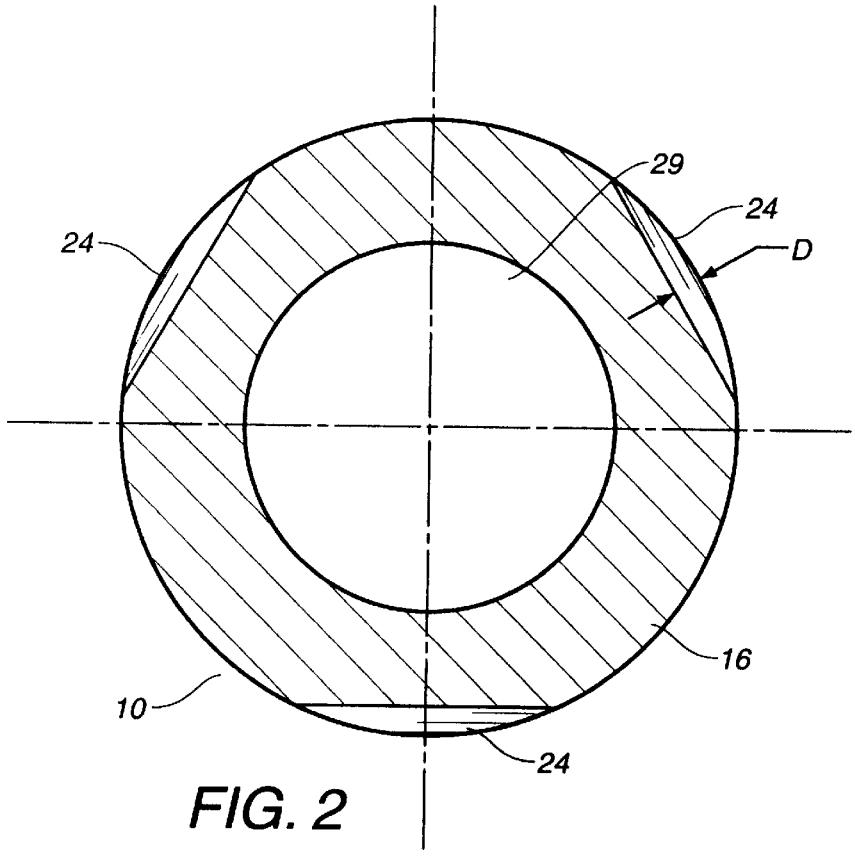
FIG. 2 is a cross-section of the heavy-weight drill pipe in FIG. 1 along line 2—2.

With reference now to FIGS. 1 and 2, the heavy weight drill pipe member of the present invention includes an elongated tubular member 10 having a longitudinal bore 29 therethrough. A first and second tool joint 20 and 22 are positioned at a respective first distal end 19 and second distal end 21 of to the tubular member 10. Each first and second tool joint 20 and 22 include a respective tubular bore 27 and 31 that communicates with the longitudinal bore 29 of the tubular member 10. The first tool joint 20 includes an externally threaded pin 23 and the second tool joint 22 includes an internally threaded box 25 (FIG. 3) for connecting another heavy weight drill pipe member to a respective first and second tool joint 20 and 22.

The first and second tool joints 20 and 22 are preferably machined separately from the tubular member 10, and then permanently attached to a respective first and second distal end 19 and 21 of the tubular member 10. The tubular member 10 and upsets 12, 14 and 16 are machined from a AISI (American Iron and Steel Institute) 4130-modified pierced, thick wall alloy steel wall tubing stock which is commercially available from the Timken Company.

The first and second tool joints 20 and 22 are machined from AISI 4145-modified also commercially available from the Timken Company. Alternatively, first and second tool joints 20 and 22 may be machined from a AISI 4130-modified tubular piece of stock.

In a preferred embodiment, a plurality of upsets 12, 14 and 16 are axially positioned along the tube section 18 for reducing bending stresses in the tubular member 10, wherein each of the plurality of upsets 12, 14 and 16 have an outside diameter greater than the outside diameter of the tubular member 10, but no greater than the outside diameter of each first and second tool joint 20 and 22. Depending on the length of the tubular member 10 and the relative deviated angle of the well bore, a single upset or protector 12, 14 or 16 may be adequate.

Figure 3:
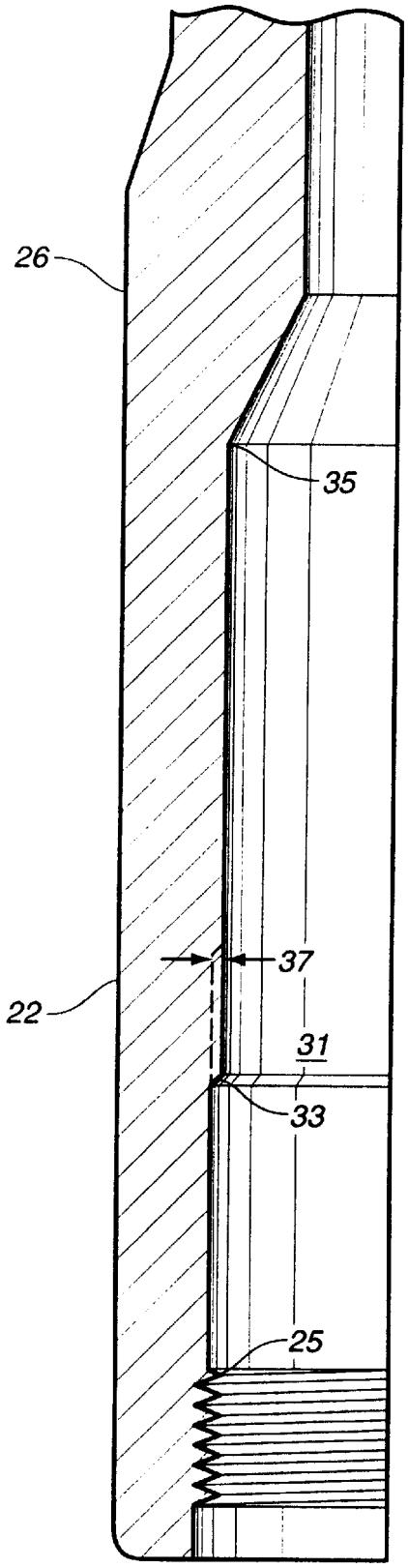
FIG. 3 is a partial cross-sectional view of the heavy weight drill pipe in FIG. 1 along line 3—3.

With reference now to FIG. 3, fatigue caused by bending stresses in the tubular member 10 may be reduced by axially extending the internal diameter of the tubular bore 31 adjacent the internally threaded box 25 from a first terminable point 33 to a second terminable point 35, such that the tubular bore 31 is constant substantially along the longitudinal axis from the internally threaded box 25 to adjacent the second distal end 21 of the tubular member 10. Although the internal diameter between 33 and 35 is slightly less than the internal diameter between the internally threaded box 25 and 33, this additional material 37 between 33 and 35 is needed for machining additional threads as the internally threaded box 25 becomes worn or cracked and must be remachined.

Stress in the tubular member 10 and corresponding stiffness in the internally threaded box 25 may thus be reduced by as much as 6½ percent when compared to the standard dimensions of an internally threaded box for a standard heavyweight drill pipe tubular member. For example, by comparing the section modulis (z) for standard 4½" heavy weight drill pipe to that of the present invention, a percentage reduction factor of stiffness in the box tool joint can be determined. If:

$$z = I/C = 0.098\left(\frac{D^4 d^4}{D}\right)$$

Then for standard 4 ½ inch heavy weight drill pipe:

$$z = .098\left(\frac{6.25^4 2.875^4}{6.25}\right) = 22.85$$

and for modified heavy weight drill pipe including a bore back:

$$z = .098\left(\frac{6.25^4 3.578^4}{6.25}\right) = 21.35$$

The corresponding difference is 22.85−21.35=1.5 or 1.5/22.85=6.56% decrease in stiffness which will reduce stresses in the tube and in turn improve fatigue life.

Referring again to FIGS. 1 and 2, upsets 12, 14 and 16 may include a spiral groove 24 in an outer circumferential surface for reducing differential pressure and sticking of the heavy weight drill pipe in the well bore. As shown in FIG. 2, each upset includes a spiral groove 24 spirally about 120° apart. The groove 24 is relatively shallow and substantially flat so that less than 4% of the middle of each upset is removed resulting in a negligible effect on the weight of the heavy weight drill pipe. For example, dimension "D" in FIG. 2 is about 7/32 inch for every 5 inches of outside diameter of the tubular member 10.

Hard banding may also be applied to the first and second tool joints 20 and 22, and upsets 12, 14 and 16 in order to reduce wear. In FIG. 1, each first and second tool joint 20 and 22 has a respective hard banded surface 26 and 28. Additionally, the middle or center upset 14 includes hard banded surfaces 30 and 32.

Although the structural features thus described for the heavy weight drill pipe are intended to reduce wear, fatigue and differential pressure sticking encountered by the heavy weight drill pipe in a well bore, the material characteristics or properties of the tubular member 10 and first and second tool joints 20 and 22 are crucial to the durability and longevity of the heavy weight drill pipe in deviated or high angle well bores having a corrosive environment. The crucial material characteristics or properties typically include material hardness, yield strength and impact strength. The material hardness is preferably measured according to Brinell hardness (BHN) which is based on an outside surface test in the tubular member 10 however, may also be measured according to a Rockwell C hardness (HRC) based on laboratory test readings which represents hardness substantially throughout the entire tubular wall. The yield strength is typically measured by PSI and the impact strength is preferably measured in foot-pounds by a Charpy-V impact test conducted at ambient temperatures in the range of 70°–74° F.

Accordingly, tubular member 10 is treated to achieve at least substantially throughout the entire tubular member 10, a BHN of about 217 to about 241 for improved resistance to stress corrosion cracking and hydrogen embrittlement, a yield strength of about 90,000 psi to about 105,000 psi for improved resistance to bending stresses, and an impact strength of at least about 100 foot pounds at ambient temperatures for improved resistance to shock loads.

In another embodiment, the tubular member 10 is treated to achieve at least substantially throughout the entire tubular body 10, a BHN of about 223 to about 235 for improved resistance to stress corrosion cracking and hydrogen embrittlement, a yield strength of about 95,000 psi to about 100,000 psi for improved resistance to bending stresses, and an impact strength of at least 100 foot pounds at ambient temperatures for improved resistance to shock loads.

In a preferred embodiment, the tubular member 10 is treated to achieve at least substantially throughout the entire tubular member 10, a BHN of about 229 for improved resistance to stress corrosion cracking and hydrogen embrittlement, a yield strength of about 95,000 psi for improved resistance to bending stresses, and an impact strength of at least about 100 foot pounds at ambient temperatures for improved resistance to shock loads.

The first and second tool joint 20 and 22 are separately machined from AISI 4145-modified and are specially treated such that at least substantially the entirety of each first and second tool joint 20 and 22 have a BHN of about 248 to about 269 for improved resistance to stress corrosion cracking and hydrogen embrittlement, a yield strength of about 100,000 psi to about 115,000 psi for improved resistance to bending stresses, and an impact strength of at least 65 foot pounds as measured by Charpy-V impact test at ambient temperatures for improved resistance to shock loads.

In another embodiment, each first and second tool joint 20 and 22 is specially treated to achieve at least substantially throughout the entirety of each first and second tool joint 20 and 22, a BHN of about 254 to about 263 for improved resistance to stress corrosion cracking and hydrogen embrittlement, a yield strength of about 105,000 psi to about 110,000 psi for improved resistance to bending stresses, and an impact strength of at last 65 foot pounds as measured by a Charpy-V impact test at ambient temperatures for improved resistance to shock loads.

In a preferred embodiment, each first and second tool joint 20 and 22 is specially treated to achieve at least substantially throughout the entirety of each first and second tool joint 20 and 22, a BHN of about 258 for improved resistance to stress corrosion cracking and hydrogen embrittlement, a yield strength of about 105,000 psi for improved resistance to bending stresses, and an impact strength of at least 65 foot pounds as measured by Charpy-V impact test at ambient temperatures for improved resistance to shock loads.

If the first and second tool joints 20 and 22 are made from AISI 4130-modified tubular stock, then the tool joints are treated to achieve at least substantially throughout the entirety of the first and second tool joints 20 and 22, a BHN of about 248 to about 269 for improved resistance to stress corrosion cracking and hydrogen embrittlement, a yield strength of about 100,000 psi to about 115,000 psi and an impact strength of at least 65 foot pounds as measured by a Charpy-V impact test at ambient temperatures for improved resistance to shock loads. The preferred material properties for the first and second tool joint 20 and 22 made from AISI 4130-modified tubular stock are substantially equivalent to the preferred material properties described above in reference to the first and second tool joints made from AISI 4145-modified tubular stock.

The preferred material properties (hardness, yield strength and impact strength) thus represent the toughness and strength of a material and are directly related to the treatment or processing of the material comprising the tubular member 10 and first and second tool joints 20 and 22. These material characteristics or properties are related to the cooling rate of the material after it has been preheated. Thus, a correlation exists between the impact energy of a material and its yield strength such that the higher the impact strength, the lower the yield strength and vice versa. Additionally, the harder the material, the higher the yield strength. The treatment of the tubular member 10 and first and second tool joints 20 and 22 yields unique material properties that permit the heavy weight drill pipe member to be used in a deviated well bore that has a corrosive environment. In order to attain these unique material characteristics or properties, a particular process of preheating, quenching and tempering the material comprising the tubular member 10 and first and second tool joints 20 and 22 is employed.

For instance, in order to achieve the material properties and characteristics for a tubular member 10 made of AISI 4130-modified tubular stock as generally described above, the tubular member 10 must first be preheated to about 1625° F. to 1675° F. where it is transformed to a phase commonly referred to as austenite. As the microstructure of the tubular member 10 becomes homogeneous and the tubular member 10 is in a solid solution state, the austenite begins to absorb alloy elements and is soon ready to be liquid quenched using water or any other suitable fluid, depending upon the required cooling rate.

Liquid quenching the tubular member 10 is a critical stage for achieving the unique combination of material properties described above because the fineness of the microstructure of the tubular member 10 is dependent upon the rate at which heat is removed. If heat is removed too slowly, the microstructure will be composed of undesirable pearlite and/or bainite. If the tubular member 10 is cooled too rapidly, the tubular member 10 may crack or even explode. Therefore, the quenching process must be fast enough to transform the microstructure to a phase commonly referred to as martensite without cracking the tubular member 10. This critical cooling rate must not only be achieved on the surface of the tubular member 10, but consistently throughout the material as well. Therefore, the tubular member 10 must have an adequate depth of hardening, which is the depth to which the rate of cooling is fast enough to transform the austenite to martensite.

Tempering is another critical stage needed for achieving the unique combination of material properties described above. After quenching the material, the tubular member 10 will preferably posses a very fine microstructure of at least 90% martensite, but will also have very high hardness and residual stress values due to the fast cooling rate. The tempering process is used to attain a phase commonly referred to as tempered martensite. The tempering process refines the material properties to achieve a preferred combination of yield strength, tensile strength, hardness, and impact strength. The tempering process is typically dependent upon the temperature and the soaking time in the tempering furnace. The temperature and soaking time thus control the microstructure and yield strength, tensile strength, hardness, impact strength, and corrosion resistance.

Accordingly, the tubular member 10 is liquid quenched for a period of about 10 to 20 minutes in order to achieve a minimum of 90 percent martensite in the microstructure and is then tempered at about 1360° F. to 1410° F. for about 20 to 40 minutes. The tempered martenistic microstructure yields a very strong, tough, ductile and resilient material suitable for both high stress applications encountered in deviated well bores and corrosive environments. Although tempering causes the tubular member 10 to lose some of its hardness, it gains toughness and resiliency resulting in the material having a close knit, small grain, martenistic microstructure having the general material characteristics or properties described above. The combined material hardness, yield strength and impact strength generally described above are sufficient to meet industry (NACE) standards by achieving a minimum 85% specified maximum yield strength according to NACE standard test procedures. These specified material properties will substantially improve the performance and durability of the heavy weight drill pipe member during high stress applications in a deviated well bore that has a corrosive environment.

In a preferred method of producing the tubular member 10, the tubular member 10 is first preheated to about 1650° F. The tubular member 10 is then liquid quenched for at least 10 minutes and then tempered to about 1385° F. for at least 20 minutes to achieve a preferred BHN of about 229, a yield strength of about 95,000 psi and on impact strength of at least about 100 foot pounds at ambient temperatures throughout substantially the entire tubular member 10.

In order to achieve material properties for the first and second tool joints 20 and 22 made of AISI 4145-modified tubular stock as generally described above, the first and second tool joint 20 and 22 are treated in similar fashion to that described above in reference to the tubular member 10. For example, each first and second tool joint 20 and 22 is first preheated to about 1695° F. to 1745° F. to achieve an austenite phase or structure. The first and second tool joint 20 and 22 are then liquid quenched using water or any other suitable fluid for a period of about 10 to 20 minutes, and then tempered to about 1270° F. to 1330° F. for about 30 to 45 minutes.

In a preferred method of producing the first and second tool joint 20 and 22, the first and second tool joint 20 and 22 are first preheated to about 1720° F. The first and second tool joint 20 and 22 are then liquid quenched for a period of at least 10 minutes and then tempered to about 1300° F. for at least 30 minutes to achieve a preferred BHN of about 258, a yield strength of about 105,000 psi and an impact strength of at least 65 foot pounds at ambient temperatures throughout substantially the entirety of each first and second tool joint 20 and 22.

If, however, the first and second tool joint 20 and 22 are machined from AISI 4130-modified tubular stock, then the tool joints are preheated to about 1625° F. to 1675° F. and then liquid quenched for about 10 to 20 minutes. The tool joints are then tempered to about 1275° F. to 1385° F. for about 20 to 45 minutes. In a preferred method of producing the first and second tool joint 20 and 22 made of AISI 4130-modified tubular stock, the tool joints are preheated to about 1650° F. and then liquid quenched for at least 10 minutes. The tool joints are then tempered to about 1300° F. for at least 20 minutes to achieve a preferred BHN of about 258, a yield strength of about 105,000 psi and an impact strength of at least 65 foot-pounds at ambient temperatures throughout substantially the entire first and second tool joint 20 and 22.

The process or treatment of preheating, liquid quenching and tempering can be achieved with either a conventional batch type heat treating system or a continuous line heat treating process (CLH). Although the preferred material properties generally described above for the tubular member 10 and first and second tool joints 20 and 22 may be obtained by either method, there is a greater assurance of uniform properties throughout the entire material using the CLH system which involves feeding the tubular member 10 and first and second tool joint 20 and 22 at a continuous rate through a furnace while rotating the same to achieve uniform treatment of the material.

Once the tubular member 10 and first and second tool joint 20 and 22 are treated as described above to attain the optimum material properties needed for use in a deviated well bore having a corrosive environment, the first and second tool joint 20 and 22 may be permanently attached to a respective first and second distal end 19 and 21 of the tubular member 10 and machined to form an externally threaded pin 23 on the first tool joint 20, and an internally threaded box 25 on the second tool joint 22 for connecting a respective heavy weight drill pipe member to the first and second tool joint 20 and 22.

From the foregoing it will be seen that this invention is one well adapted to accomplish all the ends and objects herein above set forth together with other advantages and features which are obvious and inherent to the apparatus and structure. It will be understood that certain features and subcombinations are of utility and may be employed without reference to other features and subcombinations. This is contemplated by and is within the scope of the claims. Because many possible embodiments may be made of the invention without departing from the scope thereof, it is to be understood that all matter herein set forth or shown in the accompanying drawings is to be interpreted as illustrative in a limiting sense.

We claim:

1. A heavy weight drill pipe member suitable for use in a deviated well bore having a corrosive environment comprising:

a tubular body having a longitudinal bore therethrough and a first and second distal end, at least substantially the entire tubular body having a Brinell hardness of about 217 to about 241 for improved resistance to stress corrosion cracking and hydrogen embrittlement, a yield strength of about 90,000 psi to about 105,000 psi for improved resistance to bending stresses, and an impact strength of at least about 100 foot pounds as measured by a Charpy-V impact test at ambient temperatures for improved resistance to shock loads.

2. The heavy weight drill pipe member of claim 1, wherein at least substantially the entire tubular body has a Brinell hardness of about 223 to about 235, a yield strength of about 95,000 psi to about 100,000 psi, and an impact strength of at least about 100 foot pounds.

3. The heavy weight drill pipe member of claim 1, wherein at least substantially the entire tubular body has a Brinell hardness of about 229, a yield strength of about 95,000 psi and an impact strength of at least about 100 foot pounds.

4. The heavy weight drill pipe member of claim 1, further comprising:

a first tool joint and a second tool joint, said first and second tool joint connected to a respective first and second distal end of the tubular body;

each of said first and second tool joints having an open distal end and a longitudinal bore therethrough in communication with the longitudinal bore of the tubular body;

at least substantially the entirety of each first and second tool joint having a Brinell hardness of about 248 to about 269 for improved resistance to stress corrosion cracking and hydrogen embrittlement, a yield strength of about 100,000 psi to about 115,000 psi for improved resistance to bending stresses and an impact strength of at least about 65 foot pounds as measured by a Charpy-V impact test at ambient temperatures for improved resistance to shock loads.

5. The heavy weight drill pipe member of claim 4, wherein at least substantially the entirety of each first and second tool joint has a Brinell hardness of about 254 to about 263, a yield strength of about 105,000 psi to about 110,000 psi, and an impact strength of at least about 65 foot pounds.

6. The heavy weight drill pipe member of claim 4, wherein at least substantially the entirety of each first and second tool joint has a Brinell hardness of about 258, a yield strength of about 105,000 psi and an impact strength of at least about 65 foot pounds.

7. The heavy weight drill pipe member of claim 4, wherein said first tool joint has an externally threaded pin adjacent the open distal end for threadably connecting another heavy weight drill pipe member.

8. The heavy weight drill pipe member of claim 4, wherein said second tool joint has an internally threaded box adjacent the open distal end for threadably connecting another heavy weight drill pipe member.

9. The heavy weight drill pipe member of claim 8, wherein said internally threaded box includes an axially extending internal bore that is constant substantially along the longitudinal axis from the internal threads to adjacent the second distal end of the tubular body for reducing fatigue.

10. The heavy weight drill pipe member of claim 1, further comprising:

one or more protectors positioned along the longitudinal axis of the tubular body, each of said protectors having an outside diameter greater than an outside diameter of the tubular body but no greater than an outside diameter of each first and second tool joint for limiting the bending stresses in the tubular body.

11. The heavy weight drill pipe member of claim 10, wherein each of said protectors includes a spiral groove in an outer circumferential surface for reducing differential pressure sticking of the heavy weight drill pipe in the well bore.

12. The heavy weight drill pipe member of claim 11, wherein said first and second tool joint and at least one of said protectors are hard banded substantially about an outer circumferential surface for reducing wear.

13. A heavy weight drill pipe member suitable for use in a deviated well bore having a corrosive environment comprising:

an elongate tubular member having a longitudinal bore therethrough a first tool joint and a second tool joint positioned at a respective first and second distal end of the tubular member; and at least substantially the entire tubular member having a maximum Brinell hardness of about 258 for improved resistance to stress corrosion cracking and hydrogen embrittlement, a yield strength of about 90,000 psi to about 105,000 psi for improved resistance to bending stresses and an impact strength of at least about 100 foot pounds as measured by a Charpy-V impact test at ambient temperatures for improved resistance to shock loads.

14. The heavyweight drill pipe member of claim 13, wherein said first tool joint has an externally threaded pin adjacent a distal end for threadably connecting another heavy weight drill pipe member.

15. The heavy weight drill pipe member of claim 13, wherein said second tool joint has an internally threaded box adjacent a distal end for threadably connecting another drill pipe member.

16. The heavy weight drill pipe member of claim 15, wherein said internally threaded box includes an axially extending internal bore that is constant substantially along the longitudinal axis from the internal threads to adjacent the second distal end of the tubular member for reducing fatigue.

17. The heavy weight drill pipe member of claim 13, further comprising:

one or more spaced protectors positioned along a longitudinal axis of the tubular member, each of said protectors having an outside diameter greater than an outside diameter of the tubular member but no greater than an outside diameter of the first and second tool joint for limiting the bending stresses in the tubular member.

18. The heavy weight drill pipe member of claim 17, wherein each of said protectors includes a spiral groove in an outer circumferential surface for reducing differential pressure sticking of the heavy weight drill pipe in the well bore.

19. The heavyweight drill pipe member of claim 18, wherein said first and second tool joint and at least one of said protectors are hard banded substantially about an outer circumferential surface for reducing wear.

20. A method of producing a heavy weight drill pipe member suitable for use in a deviated well bore having a corrosive environment, comprising:

preheating an elongated tubular member having a longitudinal bore therethrough, and first and second distal ends to about 1625° F. to 1675° F.;

liquid quenching said preheated tubular member for about 10 to 20 minutes; and tempering said quenched tubular member for about 20 to 40 minutes at about 1360° F. to about 1410° F. to achieve a Brinell hardness of about 217 to about 241, a yield strength of about 90,000 psi to about 105,000 psi and an impact strength of at least about 100 foot pounds throughout substantially the entire tubular member.

21. The method of producing a heavy weight drill pipe member of claim 20, further comprising:

preheating a first tool joint and a second tool joint to about 1695° F. to 1745° F., each first and second tool joint having an open distal end and a longitudinal bore therethrough;

liquid quenching said first and second tool joint for about 10 to 20 minutes;

tempering said quenched first and second tool joint for about 30 to 45 minutes at about 1270° F. to about 1330° F. to achieve a Brinell hardness of about 248 to about 269, a yield strength of about 100,000 psi to about 115,000 psi and an impact strength of at least 65 foot pounds throughout substantially the entirety of each first and second tool joint;

attaching said first and second tool joints to a respective first and second distal end of the tubular member.

22. The method of producing the heavy weight drill pipe member of claim 21, further comprising:

machining threads on an outside diameter of said first tool joint adjacent an open distal end for connecting another heavy weight drill pipe member.

23. The method of producing the heavy weight drill pipe member of claim 21, further comprising:

machining threads on an inside diameter of said second tool joint adjacent an open distal end for connecting another heavy weight drill pipe member.

* * * * *